US011401925B2

(12) United States Patent
Adler et al.

(10) Patent No.: US 11,401,925 B2
(45) Date of Patent: Aug. 2, 2022

(54) DEVICE AND METHOD FOR COMPRESSING A WORKING MEDIUM

(71) Applicant: MAXIMATOR GMBH, Nordhausen (DE)

(72) Inventors: Robert Adler, Vienna (AT); Georg Fahrthofer, Vienna (AT); Sarah Gruber, Vienna (AT); Christoph Nagl, Vienna (AT); Markus Rasch, Vienna (AT); Markus Stephan, Vienna (AT); Henning Willig, Bad Lauterberg (DE); Rene Himmelstein, Sinsheim (DE)

(73) Assignee: MAXIMATOR GMBH, Nordhausen (DE)

( * ) Notice: Subject to any disclaimer, the term of this patent is extended or adjusted under 35 U.S.C. 154(b) by 0 days.

(21) Appl. No.: 16/964,172

(22) PCT Filed: Jan. 23, 2019

(86) PCT No.: PCT/EP2019/051537
§ 371 (c)(1),
(2) Date: Jul. 22, 2020

(87) PCT Pub. No.: WO2019/145314
PCT Pub. Date: Aug. 1, 2019

(65) Prior Publication Data

US 2021/0033085 A1 Feb. 4, 2021

(30) Foreign Application Priority Data

Jan. 23, 2018 (EP) ..... 18152933

(51) Int. Cl.
*F04B 39/06* (2006.01)
*F04B 35/00* (2006.01)
(Continued)

(52) U.S. Cl.
CPC ..... *F04B 39/06* (2013.01); *F04B 9/109* (2013.01); *F04B 9/111* (2013.01); *F04B 9/113* (2013.01);
(Continued)

(58) Field of Classification Search
CPC ..... F04B 39/06; F04B 35/008
(Continued)

(56) References Cited

U.S. PATENT DOCUMENTS 3,665,808 A * 5/1972 Vestal ..... F04B 39/06 91/272
4,104,008 A * 8/1978 Hoffmann ..... F01L 25/063 417/397

(Continued)

FOREIGN PATENT DOCUMENTS

DE 3018625 A1 11/1981

OTHER PUBLICATIONS

ISA European Patent Office, International Search Report Issued in Application No. PCT/EP2019/051537, dated Feb. 21, 2019, WIPO, 2 pages.

*Primary Examiner* — Christopher S Bobish
(74) *Attorney, Agent, or Firm* — McCoy Russell LLP

(57) ABSTRACT

The invention relates to a device and a method for compressing a working medium, comprising:

compressing a drive medium in a compressor;

moving a drive piston within a first cylinder by means of the compressed drive medium;

moving a high-pressure piston, which compresses the working medium, within a second cylinder by means of the drive piston; and (Continued)

transferring heat from the compressed working medium to the compressed drive medium before the compressed drive medium enters the first cylinder of the drive piston.

16 Claims, 1 Drawing Sheet

(51) Int. Cl.

| | |
|---|---|
| ***F04B 9/133*** | (2006.01) |
| ***F04B 9/111*** | (2006.01) |
| ***F04B 9/131*** | (2006.01) |
| ***F04B 9/109*** | (2006.01) |
| ***F04B 9/129*** | (2006.01) |
| ***F04B 9/113*** | (2006.01) |

(52) U.S. Cl.
CPC ..... *F04B 9/129* (2013.01); *F04B 9/131* (2013.01); *F04B 9/133* (2013.01); *F04B 35/008* (2013.01)

(58) Field of Classification Search
USPC ..... 417/379, 390
See application file for complete search history.

(56) References Cited

U.S. PATENT DOCUMENTS

| | | | | | |
|---|---|---|---|---|---|
| 4,439,112 | A * | 3/1984 | Kitsnik | F04B 9/113 | 417/383 |
| 4,527,634 | A * | 7/1985 | Lee | A62C 35/023 | 169/13 |
| 4,569,480 | A * | 2/1986 | Levey | B05B 7/24 | 137/334 |
| 4,710,104 | A * | 12/1987 | Dring | F04B 9/1178 | 417/53 |
| 5,324,175 | A * | 6/1994 | Sorensen | F04B 9/133 | 417/254 |
| 6,386,841 | B1 | 5/2002 | Probst | | |
| 8,091,593 | B2 * | 1/2012 | Allidieres | F17C 5/007 | 141/82 |
| 8,955,323 | B2 * | 2/2015 | Kamiya | F01K 13/00 | 60/670 |
| 2011/0044830 | A1 * | 2/2011 | Scott | F04B 1/20 | 417/390 |
| 2016/0084241 | A1 * | 3/2016 | Sato | F04B 23/06 | 417/222.1 |
| 2016/0108939 | A1 * | 4/2016 | Trieb | F04B 23/06 | 60/545 |

* cited by examiner

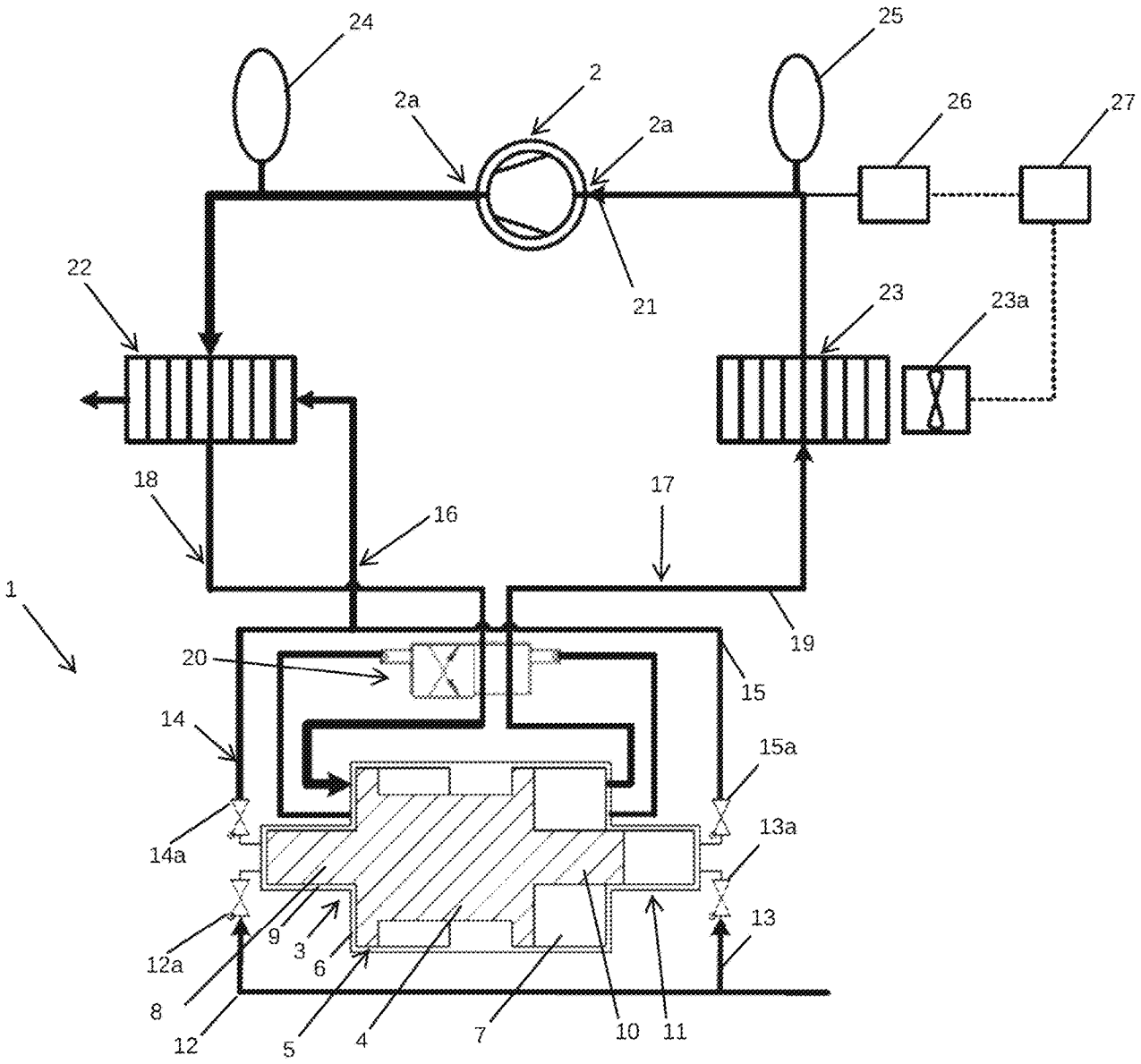
27
26
25
23a
23
2a
2
21
2a
24
22
1
18
16
17
19
20
15
15a
13a
13
11
10
7
4
6
3
5
9
8
12
12a
14a
14

DEVICE AND METHOD FOR COMPRESSING A WORKING MEDIUM

CROSS-REFERENCE TO RELATED APPLICATIONS

The present application is a U.S. National Phase of International Patent Application Serial No. PCT/EP2019/051537 entitled "DEVICE AND METHOD FOR COMPRESSING A WORKING MEDIUM," filed on Jan. 23, 2019. International Patent Application Serial No. PCT/EP2019/051537 claims priority to European Patent Application No. 18152933.0 filed on Jan. 23, 2018. The entire contents of each of the above-referenced applications are hereby incorporated by reference for all purposes.

TECHNICAL FIELD

The invention relates to a device for compressing a working medium having the features of the preamble of claim 1 and a method for compressing a working medium having the features of the preamble of claim 8.

BACKGROUND AND SUMMARY

Such compressors are known in the prior art in various designs (cf. e.g. U.S. Pat. No. 4,104,008 A). U.S. Pat. No. 4,104,008 A discloses a compressed-air-operated hydraulic pump which comprises a working chamber and a pneumatic piston, wherein the pneumatic piston is connected to a hydraulic piston. With the aid of an auxiliary slider which is sealed with respect to the working chamber and a control slider, compressed air is conveyed to the pneumatic piston in order to move this against a spring force of a helical compression spring. Due to the movement of the pneumatic piston, the hydraulic piston is moved in a hydraulic cylinder onto which a valve housing is pushed, which is used for connection of hydraulic lines.

U.S. Pat. No. 5,324,175 A discloses a two-stage, pneumatically operated air-piston compressor which comprises an integrated and coaxial drive piston, a piston for the first stage and a piston for the second stage. The pressure side of the first stage of the compressor is the suction side of the second stage. After compression in the first stage of the compressor, the air to be compressed is guided through a heat exchanger before it is further compressed in the second stage.

DE 30 18 625 A1 and U.S. Pat. No. 6,386,841 B1 disclose various designs of compressors which, however, are not designed with a view to improving the efficiency of the compressor.

However, the high energy consumption of compressors having a gas drive proves to be disadvantageous.

Against this background, it is the object of the invention to increase the efficiency for the drive of the high-pressure piston.

This object is achieved by a device according to the invention for compressing a working medium comprises at least the following components:

- a compressor for compressing a drive medium;
- a pressure translator with a drive piston which can be actuated by means of the drive medium within a first cylinder and with a high-pressure piston which compresses the working medium within a second cylinder;
- a heat exchanger between the compressor and the first cylinder of the pressure translator for transferring heat from the compressed working medium to the compressed drive medium.

According to the invention, the heat exchanger is adapted for heat exchange between the working medium after compression in the second cylinder and the drive medium before entry into the first cylinder of the pressure translator. Advantageously the temperature of the drive medium in the compressed state can thus be increased before the drive piston is exposed to the drive medium in the compressed state. As a result, a higher working power is available for operation of the high-pressure piston so that the efficiency of the compressor can be increased.

This principle can be used in various types of compressors, in particular in a single- or double-acting, single-stage or two-stage compressor. The compressor as a piston compressor can also be designed as single- or double-acting, single-stage or two-stage.

For the purposes of this disclosure, the positional and directional information such as "before", "after", "between" etc. relates to the flow direction of the drive medium or the working medium in compressor operation.

In a preferred embodiment, a closed circuit for the drive medium with a first line from the compressor to the first cylinder and with a second line from the first cylinder to the compressor is provided. In the article by Andreas P. Weiss, "Higher energy efficiency—theoretical considerations on an ideal compressed air system with closed air circuit" (original German title: "Höhere Energieeffizienz—Theoretische Überlegungen zu einem idealen Druckluftsystem mit geschlossenem Luftkreislauf", O+P 5/2009, it was shown in a different context that in a compressed air system with a compressed air cylinder, the configuration of a closed air circuit increases the energy efficiency compared with an open reference system without return of waste air.

The heat exchanger is preferably designed as a recuperator, wherein the compressed drive medium and the compressed working medium are separated from one another by means of at least one wall. In an alternative design, the heat exchanger is designed as a regenerator wherein heat storage is provided in a heat exchanger mass.

A plate heat exchanger or a tube-in-tube heat exchanger, for example, can be provided as heat exchanger. However, various designs of heat exchangers are known by means of which the heat content of the compressed working medium can be transferred to the compressed working medium.

In order to further reduce the required drive power, it is favourable if the compressor is designed to be fully hermetic or semi-hermetic.

For the purposes of this disclosure a "fully hermetic" compressor is understood as a design in which a preferably pressure-tight housing encloses both a drive motor and also a compressor unit, wherein the enclosing housing is in particular welded and the media lines are guided through the housing.

For the purposes of this disclosure a "semi-hermetic" compressor is understood as a design in which a drive motor is connected in a pressure-tight and detachable manner to a compressor housing.

In a further embodiment an open compressor is provided. For the purposes of this disclosure an "open" compressor is understood as a design in which a shaft journal or another load transfer means projects from at least one side of a compressor unit, by means of which working power can be introduced into the compressor unit.

According to a particularly preferred embodiment, the compressor and the closed circuit for the drive medium are adapted to guide the drive medium at pressure higher than ambient pressure in the circuit.

According to a preferred embodiment, a cooler for cooling the drive medium in the second line of the closed circuit is arranged between the first cylinder of the pressure translator and the compressor. In this embodiment, the temperature of the drive medium is lowered during the return from the first cylinder to the compressor. In this way, the temperature of the drive medium can be increased after compression by heat exchange with the compressed working medium without the temperature in the closed circuit as a whole being increased further and further. Advantageously therefore the working medium is guided in the closed circuit at different temperature stages in order to achieve an optimal efficiency during driving of the high-pressure piston.

In order to specifically reduce the temperature of the drive medium in the return line from the compressor to the suitable level, in a preferred embodiment there is further provided

- a temperature measuring element in the second line,
- a control unit which on the one hand is connected to the temperature measuring element and on the other hand is connected to the cooler in order to control the cooler depending on the temperature of the drive medium in the second line.

In order to compensate for pressure peaks or pressure fluctuations, there is preferably provided a first buffer storage device between the compressor and the heat exchanger and/or a second buffer storage device between the cooler and the compressor.

According to a preferred embodiment, a control slider is provided between the compressor and the first cylinder which can be switched between a first position and a second position in order to move to and from the drive piston which seals a first volume of the first cylinder with respect to a second volume of the first cylinder by means of the drive medium. In the first position, the control slider connects the first line to a first volume of the first cylinder and the second line to a second volume of the first cylinder. In the second position, the control slider connects the first line to the second volume of the first cylinder and the second line to the first volume of the first cylinder.

The method according to the invention for compressing a working medium comprises at least the following steps:

- compressing a drive medium in a compressor;
- moving a drive piston by means of the compressed drive medium within a first cylinder;
- moving a high-pressure piston which compresses the working medium by means of the drive piston within a second cylinder and
- a heat transfer from the compressed working medium to the compressed drive medium before entry of the compressed drive medium into the first cylinder of the drive piston.

According to a particularly preferred embodiment, the method further comprises the step

- guiding the drive medium in a closed circuit from the compressor via the first cylinder back to the compressor.

According to a particularly preferred embodiment, the drive medium in the compressor is compressed from an input pressure to an output pressure, wherein the input pressure is higher than an ambient pressure.

The input pressure of the drive medium at the input of the compressor is preferably between 0.5 bar and 50 bar, in particular between 2 bar and 30 bar. The output pressure of the drive medium at the output of the compressor is preferably between 1 bar and 100 bar, in particular between 5 bar and 40 bar.

For the purposes of this disclosure, all the pressure values should be understood as absolute pressures.

In order to lower the temperature of the drive medium before the compressor, a cooling of the drive medium emerging from the first cylinder is preferably undertaken by means of a cooler.

The drive medium is preferably different from the working medium. According to a particularly preferred embodiment, the drive medium is gaseous, wherein preferably one of air, nitrogen, $CO_2$, argon or krypton or a mixture thereof is provided as drive medium. The conventional compressors with gas drive have a high energy requirement in order to provide the required drive power for the drive of the high-pressure piston. As a result of the closed circuit of the drive medium on the one hand and the heat transfer from the compressed working medium to the compressed drive medium on the other hand, the efficiency during operation of the drive piston can be increased substantially.

In a particularly preferred application, the working medium is gaseous, wherein preferably molecular hydrogen is provided as working medium. Preferably the pressure of the working medium is raised from an initial pressure, in particular between 3 bar and 500 bar to a final pressure, in particular between 100 bar and 1500 bar, in particular between 700 bar and 1000 bar. These values are again each to be understood as absolute pressure.

BRIEF DESCRIPTION OF THE FIGURES

The invention will be explained further hereinafter with reference to an exemplary embodiment shown in the drawing.

FIG. 1 shows a device according to the invention for compressing a working medium by means of a high-pressure piston, wherein heat transfer is accomplished from the compressed working medium to the compressed drive medium for the drive piston.

DETAILED DESCRIPTION

FIG. 1 shows schematically a device 1 for compressing a gaseous working medium preferably molecular hydrogen. The device 1 comprises a compressor 2 for compressing a gaseous drive medium, preferably air. Various types of compressors 2 are known in the prior art. For example, the compressor 2 can be designed as a piston or rotary-screw compressor. The compressor can have precisely one stage or at least two stages. The compressor 2 increases the pressure of the drive medium from an input pressure at an input 2*a* of the compressor 2 to an output pressure at an output 2*b* of the compressor 2.

As is further apparent from the drawing, the compressed drive medium is used to drive a pressure translator 3. The pressure translator 3, also designated as pressure converter, comprises a drive piston 4 which is moved to and from within a first cylinder 5 between a first end position and a second end position. For the drive of the drive piston 4 the drive medium is guided into the first cylinder 5. The drive piston 4 seals a first volume 6 of the first cylinder 5 with respect to a second volume 7 of the first cylinder 5. The pressure translator 3 additionally comprises a high-pressure piston 8 by means of which the working medium is compressed from an initial pressure to a final pressure. The high-pressure piston 8 is movable to and fro within a second cylinder 9 between a first end position and a second end position. For this purpose, the high-pressure piston 8 is connected to the drive piston 4 in such a manner that the movement of the drive piston 4 is transmitted to the high-pressure piston 8. In order to achieve a pressure translation from the low-pressure to the high-pressure side, the high-pressure piston 8 has a smaller piston area than the drive or low-pressure piston 4. In the embodiment shown, the drive piston 4 is configured to be double-acting with a further high-pressure piston 10 within a high-pressure cylinder 11 on the side of the drive piston 4 facing away from the high-pressure piston 8. The working medium is supplied with an initial pressure via a first supply line 12 to the second cylinder 9 and via a second supply line 13 to the high-pressure cylinder 11. After the compression, the working medium at the final pressure is led off from the second cylinder 9 via a first discharge line 14 and from the high-pressure cylinder 11 via a second discharge line 15. Valves 12*a*, 13*a*, 14*a*, 15*a* are provided in the supply and discharge lines. In the embodiment shown the first discharge line 14 and the second discharge line 15 are combined in a common discharge line 16. In a single-acting design of the drive piston 4 (not shown) only a first discharge line 14 is provided.

As is further apparent from FIG. 1, the working medium is guided in a closed circuit 17. The closed circuit 17 comprises a first line 18 from the output 2*a* of the compressor 2 to the first cylinder 5 and a second line 19 (return) from the first cylinder 5 back to the input 2*b* of the compressor 2. In addition, a control device, in particular a control slider 20 is provided for changing the flow direction of the drive medium in the first cylinder 5. As a result, depending on the position of the control device, the drive piston 4 can be placed under pressure from one side or from the other side so that the switching of the control device brings about the to and fro movement of the drive piston 2. In the embodiment shown, the compressor 2 is designed to be fully hermetic or semi-hermetic. Advantageously gas leaks can thus be reduced.

As is apparent from FIG. 1, the drive medium is guided, when viewed in the flow direction 21 of the drive medium, between the compressor 2 and the first cylinder 5 of the pressure translator 3 via a heat exchanger 22 in which heat exchange is carried out with the compressed working medium. For this purpose, the heat exchanger 22 is connected to the first discharge line 14 and/or to the second discharge line 15, in the case of the double-acting compressor shown to the common discharge line 16. Thus, the heat content of the working medium after compression in the second cylinder 9 can be increased to increase the temperature of the drive medium before entry into the first cylinder 5 for the drive piston 4. It follows from the ideal gas equation ($p*V=n*R*T$) that the product $p*V$ is increased when the temperature of the compressed drive medium is increased. The work that can be furnished and therefore power at the pressure converter is thereby increased. Thus, for the same work compared to a conventional system less (electrical) drive energy is required for the compressor 2.

In the embodiment shown, a cooler 23 is additionally arranged in the second line 19 in order to achieve a cooling of the drive medium on the way from the first cylinder 5 of the pressure translator 3 back to the compressor 2. The cooler 23 can be configured as a further heat exchanger with a fan 23*a*. In the embodiment shown a temperature measuring element 26 is additionally provided in the second line 19 which transmits the temperature of the working medium to a control unit 27 which actuates the fan 23*a* depending on the temperature of the drive medium in the second line 19.

Furthermore, a first buffer storage device 24 is provided between the compressor 2 and the heat exchanger 22 and a second buffer storage device 25 is provided between the cooler 23 and the compressor 2.

For better clarity, only the components required to understand the embodiment shown are depicted in the drawing. Naturally, the compressor device 1 can have various additional components and modifications compared to the embodiment shown.

The invention claimed is:

1. A device for compressing a working medium comprising:

a compressor for compressing a gaseous drive medium;

a pressure translator with a drive piston which can be actuated by means of the gaseous drive medium within a first cylinder and with a high-pressure piston which compresses the working medium within a second cylinder, wherein the high-pressure piston has a smaller piston area than the drive piston; and a heat exchanger between the compressor and the first cylinder of the pressure translator for transferring heat from the compressed working medium to the compressed gaseous drive medium.

2. The device according to claim 1, further comprising:

a closed circuit for the gaseous drive medium with a first line from the compressor to the first cylinder and with a second line from the first cylinder to the compressor.

3. The device according to claim 2, wherein the compressor is designed to be fully hermetic, semi-hermetic or open.

4. The device according to claim 3, wherein the compressor and the closed circuit for the gaseous drive medium are adapted to guide the drive medium at pressure higher than ambient pressure in the circuit.

5. The device according to claim 4, further comprising a cooler for cooling the gaseous drive medium in the second line between the first cylinder of the pressure translator and the compressor.

6. The device according to claim 5, further comprising:

a temperature measuring element in the second line, and a control unit which on the one hand is connected to the temperature measuring element and on the other hand is connected to the cooler in order to control the cooler depending on the temperature of the gaseous drive medium in the second line.

7. The device according to claim 5, further comprising:

a first buffer storage device between the compressor and the heat exchanger and/or a second buffer storage device between the cooler and the compressor.

8. A method for compressing a working medium comprising:

compressing a gaseous drive medium in a compressor;

moving a drive piston by means of the compressed gaseous drive medium within a first cylinder; and moving a high-pressure piston which compresses the working medium by means of the drive piston within a second cylinder, wherein heat is transferred from the compressed working medium to the compressed drive medium before entry of the compressed gaseous drive medium into the first cylinder of the drive piston, and the high-pressure piston has a smaller piston area than the drive piston.

9. The method according to claim 8, wherein the working medium is gaseous.

10. The method according to claim 9, wherein the working medium is molecular hydrogen.

11. The method according to claim 8, further comprising:

guiding the gaseous drive medium in a closed circuit from the compressor via the first cylinder back to the compressor.

12. The method according to claim 11, wherein the gaseous drive medium in the compressor is compressed from an input pressure to an output pressure, wherein the input pressure is higher than an ambient pressure.

13. The method according to claim 12, wherein the input pressure is between 0.5 bar and 50 bar.

14. The method according to claim 13, further comprising:

cooling the gaseous drive medium emerging from the first cylinder by means of a cooler.

15. The method according to claim 13, wherein the input pressure is between 2 bar and 30 bar.

16. The method according to claim 14, wherein the gaseous drive medium is selected from air, nitrogen, $CO_2$, argon or krypton or a mixture thereof.

* * * * *